US006443639B1

(12) United States Patent
Thering et al.

(10) Patent No.: US 6,443,639 B1
(45) Date of Patent: Sep. 3, 2002

(54) SLOT COATER DEVICE FOR APPLYING DEVELOPER TO FILM FOR ELECTRONIC FILM DEVELOPMENT

(75) Inventors: Michael R. Thering; George G. Mooty; Richard A. Coleman; Roland W. Porth; Robert S. Young, Jr.; Leland A. Lester, all of Austin, TX (US)

(73) Assignee: Applied Science Fiction, Inc., Austin, TX (US)

( * ) Notice: Subject to any disclaimer, the term of this patent is extended or adjusted under 35 U.S.C. 154(b) by 0 days.

(21) Appl. No.: 09/607,411

(22) Filed: Jun. 29, 2000

Related U.S. Application Data

(60) Provisional application No. 60/141,311, filed on Jun. 29, 1999.

(51) Int. Cl.[7] ..... G03D 3/02; G03D 13/00; G03D 5/00

(52) U.S. Cl. ..... 396/567; 396/604; 396/627

(58) Field of Search ..... 396/604, 627, 396/636, 641, 626, 567–570; 118/411, 500; 430/434; 355/27–29

(56) References Cited

U.S. PATENT DOCUMENTS

| | | | | | |
|---|---|---|---|---|---|
| 2,404,138 | A | * | 7/1946 | Mayer | 95/94 |
| 3,520,689 | A | * | 7/1970 | Nagae et al. | 96/55 |
| 3,520,690 | A | * | 7/1970 | Nagae et al. | 96/55 |
| 3,587,435 | A | * | 6/1971 | Chioffe | 95/89 |
| 3,615,479 | A | * | 10/1971 | Kohler et al. | 96/48 |

(List continued on next page.)

FOREIGN PATENT DOCUMENTS

| | | | |
|---|---|---|---|
| EP | 0 261 782 A2 | 8/1987 | H04N/1/46 |
| EP | 0 422 220 A1 | 3/1989 | A61B/6/03 |
| EP | 0 482 790 B1 | 9/1991 | H04N/1/40 |
| EP | 0 525 886 A3 | 7/1992 | G03D/5/00 |
| EP | 0 580 293 A1 | 6/1993 | H04N/1/04 |

(List continued on next page.)

OTHER PUBLICATIONS

"*Adaptive Fourier Threshold Filtering: A Method to Reduce Noise and Incoherent Artifacts in High Resolution Cardiac Images*", Doyle, M., et al., 8306 Magnetic Resonance in Medicine 31, No. 5, Baltimore, MD, May, pp. 546–550, 1994.*

"*Anisotropic Spectral Magnitude Estimation Filters for Noise Reduction and Image Enhancement*", Aich, T., et al., Philips GmbH Research Laboratories, IEEE, pp. 335–338, 1996.*

"*Adaptive–neighborhood filtering of images corrupted by signal–dependent noise*", Rangayyan, R., et al., Applied Optics, vol. 37, No. 20, pp. 4477–4487, Jul. 10, 1998.*

"*Grayscale Characteristics*", The Nature of Color Images, Photographic Negatives, pp. 163–168.*

"*Parallel Production of Oligonucleotide Arrays Using Membranes and Reagent Jet Printing*", Stimpson, D., et al., Research Reports, BioTechniques, vol. 25, No. 5, pp. 886–890, 1998.*

"*Low–Cost Display Assembly and Interconnect Using Ink–Jet Printing Technology*", Hayes, D. et al., Display Works '99, MicroFab Technologies, Inc., pp. 1–4, 1999.*

(List continued on next page.)

*Primary Examiner*—D Rutledge
(74) *Attorney, Agent, or Firm*—Dinsmore & Shohl LLP

(57) ABSTRACT

A slot coater device is provided for applying a processing solution, such as developer, to film during film development. The slot coater includes a housing having an opening for dispensing the processing solution, a reservoir within the housing adapted to receive a predetermined amount of the processing solution, and a channel for delivering the processing solution from the reservoir to the opening.

21 Claims, 8 Drawing Sheets

U.S. PATENT DOCUMENTS 3,615,498 A * 10/1971 Aral ..... 96/55
3,617,282 A * 11/1971 Bard ..... 96/59
3,747,120 A * 7/1973 Stemme ..... 346/75
3,833,161 A 9/1974 Krumbein ..... 226/92
3,903,541 A * 9/1975 Von Meister et al. ..... 354/317
3,946,398 A * 3/1976 Kyser et al. ..... 346/1
3,959,048 A * 5/1976 Stanfield et al. ..... 156/94
4,026,756 A * 5/1977 Stanfield et al. ..... 156/554
4,081,577 A * 3/1978 Horner ..... 427/424
4,142,107 A * 2/1979 Hatzakis et al. ..... 250/571
4,215,927 A * 8/1980 Grant et al. ..... 354/317
4,249,985 A * 2/1981 Stanfield ..... 156/554
4,265,545 A 5/1981 Slaker ..... 356/431
4,301,469 A * 11/1981 Modeen et al. ..... 358/75
4,490,729 A * 12/1984 Clark et al. ..... 346/75
4,501,480 A * 2/1985 Matsui et al. ..... 354/298
4,533,225 A * 8/1985 Shiga ..... 396/626
4,564,280 A 1/1986 Fukuda ..... 354/317
4,594,598 A 6/1986 Iwagami ..... 346/140
4,621,037 A 11/1986 Kanda et al. ..... 430/30
4,623,236 A * 11/1986 Stella ..... 396/604
4,633,300 A 12/1986 Sakai ..... 358/41
4,636,808 A 1/1987 Herron ..... 346/75
4,666,307 A 5/1987 Matsumoto et al. ..... 356/404
4,670,779 A 6/1987 Nagano ..... 358/75
4,736,221 A 4/1988 Shidara ..... 354/317
4,741,621 A 5/1988 Taft et al. ..... 356/376
4,745,040 A 5/1988 Levine ..... 430/21
4,755,844 A 7/1988 Tsuchiya et al. ..... 354/317
4,777,102 A 10/1988 Levine ..... 430/21
4,796,061 A 1/1989 Ikeda et al. ..... 355/73
4,814,630 A 3/1989 Lim ..... 250/578
4,821,114 A 4/1989 Gebhardt ..... 358/75
4,845,551 A 7/1989 Matsumoto ..... 358/80
4,851,311 A 7/1989 Millis et al. ..... 430/30
4,857,430 A 8/1989 Millis et al. ..... 430/30
4,875,067 A 10/1989 Kanzaki et al. ..... 354/325
4,941,008 A * 7/1990 Nakamura ..... 396/626
4,969,045 A 11/1990 Haruki et al. ..... 358/228
4,977,422 A * 12/1990 Manico et al. ..... 396/627
4,994,918 A 2/1991 Lingemann ..... 358/214
5,027,146 A 6/1991 Manico et al. ..... 354/299
5,034,767 A * 7/1991 Netz et al. ..... 396/604
5,101,286 A 3/1992 Patton ..... 358/487
5,124,216 A 6/1992 Giapis et al. ..... 430/30
5,155,596 A 10/1992 Kurtz et al. ..... 358/214
5,196,285 A 3/1993 Thomson ..... 430/30
5,200,817 A 4/1993 Birnbaum ..... 358/80
5,212,512 A 5/1993 Shiota ..... 354/319
5,231,439 A 7/1993 Takahashi et al. ..... 354/313
5,235,352 A 8/1993 Pies et al. ..... 346/140
5,255,408 A 10/1993 Blackman ..... 15/308
5,266,805 A 11/1993 Edgar ..... 250/330
5,267,030 A 11/1993 Giorgianni et al. ..... 358/527
5,292,605 A 3/1994 Thomson ..... 430/30
5,296,923 A 3/1994 Hung ..... 358/527
5,334,247 A * 8/1994 Columbus et al. ..... 118/411
5,350,651 A 9/1994 Evans et al. ..... 430/21
5,350,664 A 9/1994 Simons ..... 430/362
5,357,307 A * 10/1994 Glanville et al. ..... 396/626
5,360,701 A 11/1994 Elton et al. ..... 430/501
5,371,542 A 12/1994 Pauli et al. ..... 348/262
5,391,443 A 2/1995 Simons et al. ..... 430/21
5,414,779 A 5/1995 Mitch ..... 382/199
5,416,550 A 5/1995 Skye et al. ..... 354/298
5,418,119 A 5/1995 Simons ..... 430/507
5,418,597 A 5/1995 Lahcanski et al. ..... 355/76
5,432,579 A 7/1995 Tokuda ..... 354/293
5,436,738 A 7/1995 Manico ..... 358/503
5,440,365 A 8/1995 Gates et al. ..... 354/298
5,447,811 A 9/1995 Buhr et al. ..... 430/20
5,448,380 A 9/1995 Park ..... 358/520
5,452,018 A 9/1995 Capitant et al. ..... 348/651
5,465,155 A * 11/1995 Edgar ..... 358/500
5,477,345 A 12/1995 Tse ..... 358/500
5,496,669 A 3/1996 Pforr et al. ..... 430/22
5,516,608 A 5/1996 Hobbs et al. ..... 430/30
5,519,510 A * 5/1996 Edgar ..... 358/471
5,546,477 A 8/1996 Knowles et al. ..... 382/242
5,550,566 A 8/1996 Hodgson et al. ..... 345/202
5,552,904 A 9/1996 Ryoo et al. ..... 358/518
5,563,717 A 10/1996 Koeng et al. ..... 358/406
5,568,270 A 10/1996 Endo ..... 358/298
5,576,836 A 11/1996 Sano et al. ..... 358/302
5,581,376 A 12/1996 Harrington ..... 358/518
5,587,752 A 12/1996 Petruchik ..... 396/315
5,596,415 A 1/1997 Cosgrove et al. ..... 358/296
5,627,016 A 5/1997 Manico ..... 430/434
5,649,260 A 7/1997 Wheeler et al. ..... 396/569
5,664,253 A 9/1997 Mevers ..... 396/603
5,664,255 A * 9/1997 Wen ..... 396/627
5,667,944 A 9/1997 Reem et al. ..... 430/359
5,678,116 A 10/1997 Sugimoto et al. ..... 396/611
5,691,118 A 11/1997 Haye ..... 430/357
5,695,914 A 12/1997 Simon et al. ..... 430/379
5,698,382 A 12/1997 Nakahanada et al. ..... 430/418
5,726,773 A 3/1998 Mehlo et al. ..... 358/474
5,739,897 A 4/1998 Frick et al. ..... 355/40
5,771,107 A 6/1998 Fujimoto et al. ..... 358/464
5,790,277 A 8/1998 Edgar ..... 358/487
5,835,795 A 11/1998 Craig et al. ..... 396/6
5,835,811 A 11/1998 Tsumura ..... 396/598
5,870,172 A 2/1999 Blume ..... 355/27
5,880,819 A 3/1999 Tanaka et al. ..... 355/75
5,892,595 A 4/1999 Yamakawa et al. ..... 358/530
5,930,388 A 7/1999 Murakami et al. ..... 382/167
5,959,720 A 9/1999 Kwon et al. ..... 355/38
5,963,662 A 10/1999 Vachtsevanos et al. ..... 382/150
5,966,465 A 10/1999 Keith et al. ..... 382/232
5,979,011 A 11/1999 Miyawaki et al. ..... 15/308
5,982,936 A 11/1999 Tucker et al. ..... 382/233
5,982,937 A 11/1999 Accad ..... 382/239
5,982,941 A 11/1999 Loveridge et al. ..... 382/260
5,982,951 A 11/1999 Katayama et al. ..... 382/284
5,988,896 A * 11/1999 Edgar ..... 396/604
5,991,444 A 11/1999 Burt et al. ..... 382/232
5,998,109 A * 12/1999 Hirabayashi ..... 430/434
6,000,284 A 12/1999 Shin et al. ..... 73/150
6,005,987 A 12/1999 Nakamura et al. ..... 382/294
6,045,273 A * 4/2000 Hagawara et al. ..... 396/604
6,065,824 A 5/2000 Bullock et al. ..... 347/19
6,069,714 A 5/2000 Edgar ..... 358/487
6,088,084 A 7/2000 Nishio ..... 355/75
6,089,687 A 7/2000 Helterline ..... 347/7
6,101,273 A 8/2000 Matama ..... 382/169
6,102,508 A 8/2000 Cowger ..... 347/7
6,137,965 A 10/2000 Burgeios et al. ..... 396/626
6,200,738 B1 3/2001 Takano et al. ..... 430/362

FOREIGN PATENT DOCUMENTS

EP 0 580 293 A1 1/1994 ..... H04N/1/04
EP 0 601 364 A1 6/1994 ..... H04N/1/387
EP 0 669 753 A2 2/1995 ..... H04N/1/407
EP 0 794 454 A2 2/1997 ..... G03B/27/73
EP 0 768 571 A2 4/1997 ..... G03D/13/00
EP 0 806 861 A1 11/1997 ..... H04N/1/00
EP 0 878 777 A2 11/1998 ..... G06T/5/40
EP 0 930 498 A2 12/1998 ..... G01N/21/88
WO WO 90/01240 * 2/1990 ..... H04N/1/40
WO WO 91/09493 * 6/1991 ..... H04N/5/217
WO WO 97/25652 * 7/1997 ..... G03D/5/00

| | | | | |
|---|---|---|---|---|
| WO | WO 98/19216 | * | 5/1998 | ..... G03C/5/29 |
| WO | Wo 98/25399 | | 6/1998 | ..... H04N/1/38 |
| WO | WO 98/31142 | * | 7/1998 | ..... H04N/5/253 |
| WO | WO 93/34157 | * | 8/1998 | |
| WO | WO 98/34157 | | 8/1998 | |
| WO | WO 98/34397 | | 8/1998 | |
| WO | WO 99/43148 | | 8/1999 | ..... H04N/1/00 |
| WO | WO 99/43149 | | 8/1999 | ..... H04N/1/100 |
| WO | WO 01/01197 | | 1/2001 | ..... G03D/5/00 |
| WO | WO 01/13174 A1 | | 2/2001 | ..... G03D/5/06 |
| WO | WO 01/45042 A1 | | 6/2001 | ..... G06T/5/00 |
| WO | WO 01/50192 A1 | | 7/2001 | ..... G03C/7/407 |
| WO | WO 01/50194 A1 | | 7/2001 | ..... G03C/7/407 |
| WO | WO 01/50197 A1 | | 7/2001 | ..... G03C/7/42 |
| WO | WO 01/52556 A2 | | 7/2001 | ..... H04N/9/11 |

OTHER PUBLICATIONS

"*Ink–Jet Based Fluid Microdispensing in Biochemical Applications*", Wallace, D., MicroFab Technologies, Inc., Laboratory Automation News, vol. 1, No. 5, pp. 6–9, Nov., 1996.*

"Protorealistic Ink–Jet Printing Through Dynamic Spot Size Control", Wallace, D., Journal of Imaging Science and Technology, vol. 40, No. 5, p. 390–395, Sep./Oct. 1996.

"MicroJet Printing of Solder and Polymers for Multi–Chip Modules and Chip–Scale Package", Hayes, D., et al., MicroFab Technologies, Inc.

"A Method of Characteristics Model of a Drop–on–Demand Ink–Jet Device Using an Integral Method Drop Formation Model", Wallace, D., MicroFab Technologies, Inc., The American Society of Mechanical Engineers, Winter Annual Meeting, pp. 1–9, Dec. 10–15, 1989.

"Digital Imaging Equipment White Papers", Putting Damaged Film on ICE, www.nikonusa.com/reference/whitepapers/imaging, Nikon Corporation, Nov. 28, 2000.

* cited by examiner

SLOT COATER DEVICE FOR APPLYING DEVELOPER TO FILM FOR ELECTRONIC FILM DEVELOPMENT

CROSS REFERENCE TO RELATED APPLICATION

This application claims priority from Provisional Application Serial No. 60/141,311, filed Jun. 29, 1999.

BACKGROUND OF THE INVENTION

1. Field of the Invention

The present invention relates to film processing and, particularly, to a slot coater system and method of operation.

2. Description of the Related Art

In developing photographic film, a number of processing solutions are generally used to develop and stabilize the image on the photographic film. One such method for developing photographic film is traditional chemical film development. The traditional chemical film development process generally includes the steps of developing, stopping, fixing, clearing, washing, drying, and sealant. With the exception of drying, each of these processing steps generally requires the application of a different processing solution to the film. The processing solutions are generally applied to the film by showering or dipping the film in different containers of processing solutions. The used processing solutions are often hazardous chemicals and their disposal is regulated by government agencies.

A relatively new photographic film processing method is digital film development. Digital film development is a method of electronically digitizing the images stored on the film during the film development process. In electronic development, the electronic digitizing process involves scanning the film through the processing solution. In other words, when the image on the film is scanned, the film is still wet with processing solutions. As a result, it is desirable to uniformly apply the processing solution to the film.

Conventional methods have the disadvantage of failing to provide a uniform application of processing solutions. Another disadvantage of conventional processes is the requirement for disposal of used and excess processing solutions.

SUMMARY OF THE INVENTION

These and other drawbacks are overcome in large part by a system and method according to the present invention. Briefly summarized, a slot coater system and method of operation are provided for applying processing solutions to film. In one embodiment of the present invention, a slot coater is provided. In this embodiment, the slot coater includes a housing having an opening for dispensing a processing solution, a reservoir within the housing adapted to provide a substantially uniform pressure across the width of the housing, and a channel for delivering the processing solution from the reservoir to the opening. According to a particular embodiment, the slot coater is formed as a replaceable cartridge.

In another embodiment of the present invention, a film processing system is provided. In this embodiment, the film processing system comprises a delivery system that includes a slot coater operable to apply a processing solution to film. In a particular embodiment, the film processing system further comprises an imaging station operable to digitize an image on the film.

One or more embodiments of the invention provide important technical advantages. Various embodiments of the invention may have none, some, or all of these advantages. For example, in some embodiments, the slot coater has the advantage of applying a substantially uniform coat of processing solutions on the film. Another advantage is that the slot coater uses relatively little processing solution relative to conventional viscous film processing fluid. As such, disposal of excess film processing fluid is not required.

BRIEF DESCRIPTION OF THE DRAWINGS

A better understanding of the invention is obtained when the following detailed description is considered in conjunction with the following drawings, wherein like reference numerals represent like features, in which.

DETAILED DESCRIPTION OF THE INVENTION

FIGS. 1–10 illustrate a slot coater system and method of operation. As will be discussed in greater detail below, the slot coater system includes a slot coater head adapted to receive and apply a processing solution to film. The slot coater system according to the present invention provides a substantially even layer of processing solution to the film.

Figures 1, 2:
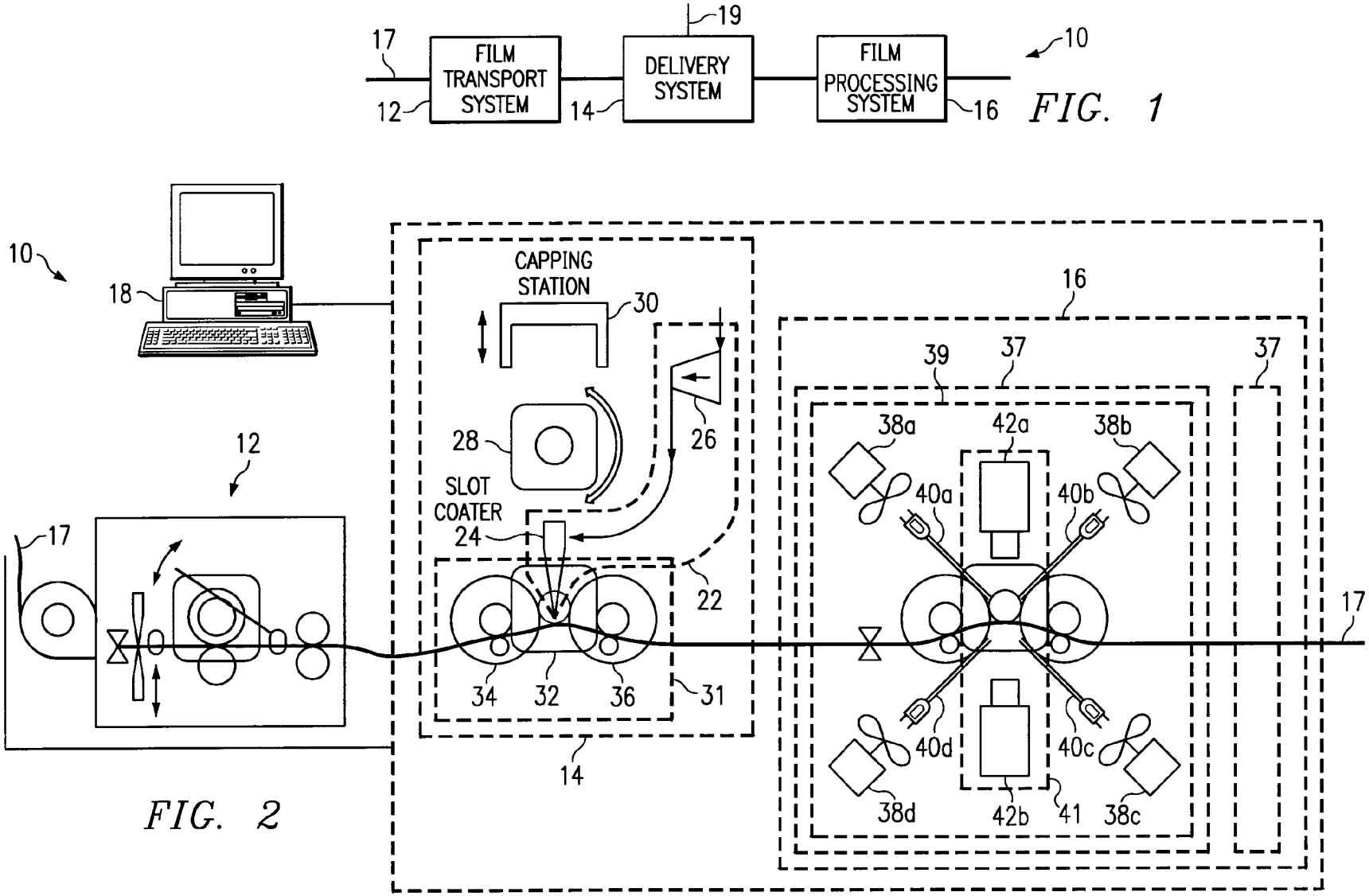
FIG. 1 is a block diagram of a film processor in accordance with one embodiment of the invention.
FIG. 2 is a diagram of an electronic film development system in accordance with one embodiment of the invention.

Turning now to the drawings and, with particular attention to FIG. 1, a film processor 10 according to one embodiment of the invention is illustrated. In this embodiment, the film processor 10 includes a film transport system 12, a processing solution delivery system 14, and a film processing system 16.

The film transport system 12 operates to receive, dispense and transport a film 17 through the various stations within the film processor 10. In one embodiment, the film transport system 12 comprises a series of rollers that frictionally contact the film 17 to move the film. In another embodiment, the film transport system 12 comprises a parallel system of bands that pinch the edges of the film and guide the film 17 through the film processor 10. The film transport system 12 may comprise any suitable device or system for transporting film.

As described in greater detail below, the delivery system 14 includes a slot coater assembly for applying a layer of a processing solution 19 to the film 17. In one embodiment of delivery system 14, a single slot coater assembly is used to coat the processing solution 19 onto the film 17. In another embodiment, multiple slot coaters are used to apply multiple or different processing solutions 19 to the film 17. The different processing solutions 19 applied by the slot coater can also be applied before and after various stages of processing the film 17.

The processing solution 19 dispensed by the delivery system 14 may include any suitable film processing fluid. The specific type of processing solution 19 will depend upon the particular type of film processor 10. For example, in one embodiment of film processor 10 the processing solution 19 comprises a developer solution that is applied to the film. In other embodiments of film processor 10, different processing solutions 19 are applied to the film 17 using separate slot coaters or delivery systems 14. For example, the processing solution 19 may comprise a developer such as HC-110 combined with a thickening agent such as hydroxyethylcellulose having a viscosity of about 25 to 30,000 cps. Other film processing fluids, such as sodium hydroxide as an accelerator, stop solution, fixer solution, blix solution, water, or bleach solution as these chemical solutions are known in the photographic industry. It will also be understood that the processing solution 19 may be any other suitable type of fluid used in the film development process, such as silver halide emulsion containing couplers.

A more detailed view of one embodiment of a film processor 10 and, particularly, an electronic film processing system according to the present invention, is shown in FIG. 2. The film processor 10 is controlled by one or more processing units 18. The processing unit 18 may be embodied as a PC or PC compatible computer employing a Pentium or compatible processor, or RS 6000 workstation available from IBM Corporation. The processing unit 18 is programmed to control operation of the film processor 10 and to process images received there from, as will be explained in greater detail below.

The film processor 10 is loaded with film 17 at the film transport system 12. The film 17 may be any standard film such as 35 mm film or Advanced Photo System (APS) film, available from Eastman Kodak Co., Rochester, N.Y. The film transport system 12 provides the film 17 to the delivery system 14 according to the present invention.

According to one embodiment of the present invention, the delivery system 14 includes a slot coater assembly 22 for applying the processing solution 19 to the film 17. The slot coater assembly 22 may include a slot coater head 24 and a dispenser system 26 for providing processing solution to the slot coater head 24. As will be discussed in greater detail below, the dispenser system 26 may comprise any suitable system operable to dispense the processing solution 19 to the slot coater head 24.

As shown in FIG. 2, the delivery system 14 includes a locating system 28, such as a step motor, for controlling the placement of the slot coater head 24 onto the film 17. In addition, a capping station 30 may be provided to seal the slot coater head 24 when not in use. The capping station 30 may further be used to wipe clean the slot coater head 24 and provide a receptacle for the processing solution 19 when priming or purging the slot coater head 24. A transport subsystem 31, which may include a step motor 32 and rollers 34, 36, may be provided as part of the film transport system 12 to advance the film 17 through the delivery system 14.

Once the processing solution 19 has been applied to the film 17, the film 17 is advanced toward the film processing system 16. In the electronic film development embodiment illustrated, the film processing system 16 comprises one or more imaging stations 37. In one embodiment, the film processing system 16 comprises a single imaging station 37. In another embodiment, the film processing system 16 comprises multiple imaging stations 37 that operate to scan the film 17 at multiple development times. For simplicity, only one imaging station 37 is fully illustrated in FIG. 2. Imaging station 37 comprises an illumination system 39. In the embodiment illustrated, the illumination system 39 comprises one or more illuminators 38*a*–38*d*, which provide for scanning along paths 40*a*–40*d*, respectively. The paths 40*a*–40*d* may include one or more wave-guides for focusing the light onto film 17. In another embodiment, the illumination system 39 comprises one or more lenses.

The illumination system 39 operates to illuminate the film 17 with electromagnetic energy, i.e., light. In one embodiment, the illumination system 39 produces visible light, i.e., light within the electromagnetic spectrum that is visible to the human eye. In another embodiment, the illumination system 39 produces infrared light. In yet another embodiment, the illumination system 39 operates to produce visible and infrared light concurrently and alternatively, such as through the use of a color wheel.

The imaging station 37 also comprises a sensor system 41 operable to sense the electromagnetic from the illumination system 39. In the embodiment illustrated, the sensor system 41 comprises one or more digital image capturing devices, such as cameras 42*a*, 42*b*. The cameras 42*a*, 42*b* may be embodied as linear charge coupled device (CCD) arrays, such as CCD arrays available from DALSA. The images are then provided along a known interface (not shown), such as a parallel port interface, to the processing unit 18.

In the embodiment of electronic film processing system illustrated, the opposing pair of cameras 42*a*, 42*b* receive light reflected from the front (emulsion side), back (base side) and transmitted through the film 17 for each pixel, which are then resolved by the processing unit 18 in a known manner. One such method is described in U.S. Pat. No. 5,519,510, which is hereby incorporated by reference in its entirety as if fully set forth herein.

Figure 3:
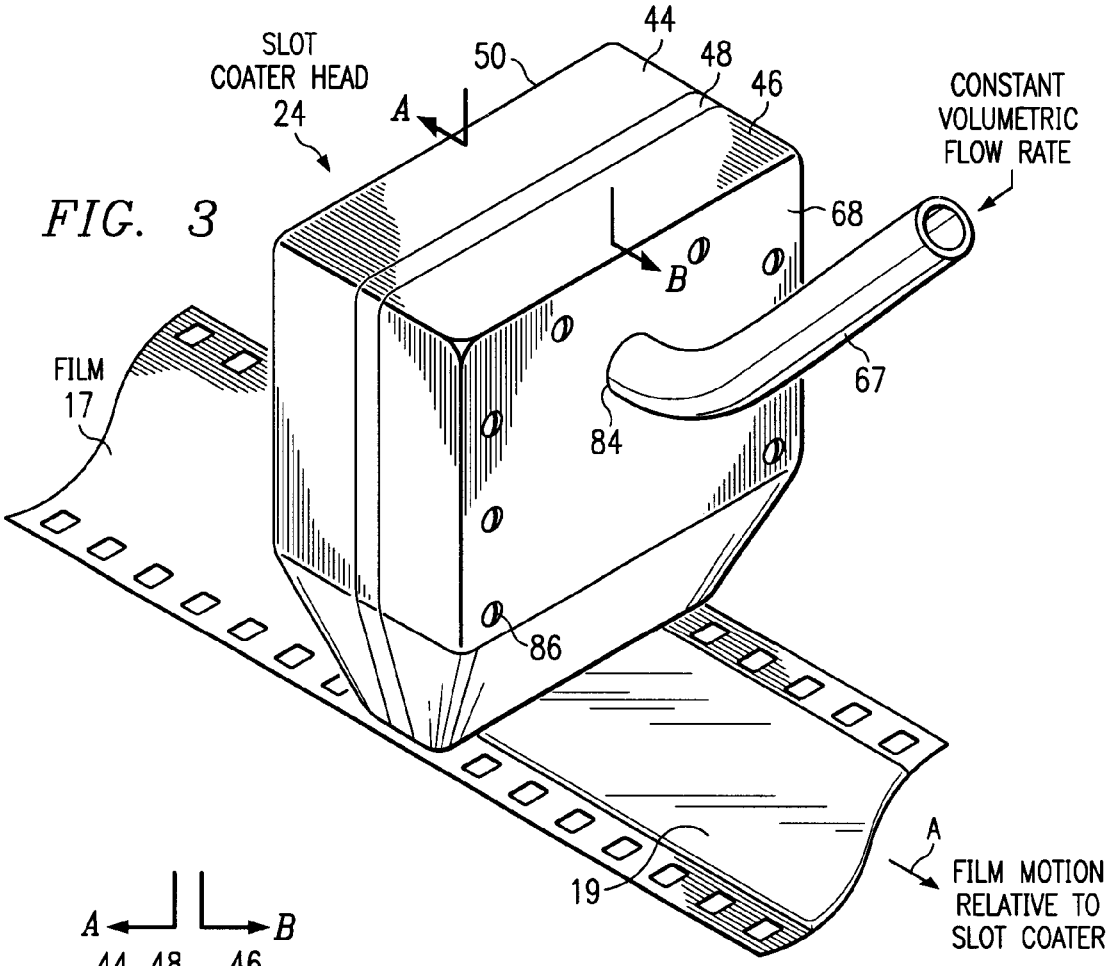
FIG. 3 is a diagram of a slot coater head for use in the electronic development system of FIG. 2.

One embodiment of the slot coater head 24 is illustrated in greater detail in FIGS. 3–5. According to the embodiment illustrated, the slot coater head 24 includes a housing having an anterior portion 44 and a posterior portion 46. A shim 48 having predetermined thickness separates the anterior portion 44 and the posterior portion 48.

The anterior portion 44 (FIGS. 3, 4A, 5C) includes an external face 50, an internal face 52, and side surfaces 54, 56. The side surfaces 54, 56 may include beveled portions 58, 60 respectively, which taper to a predetermined width to the surface 62. The external face 50 also may include a beveled portion 64, which tapers to the surface 62. As will be discussed in greater detail below, the anterior portion 44 may further include a trough or reservoir 66 for holding developer, which is provided via a feed pipe 67.

The posterior portion 46 (FIGS. 3, 4A, 5A) includes an external face 68, an internal face 70, and side surfaces 72, 74. The side surfaces 72, 74 may include beveled portions 76, 78, which taper to the surface 80, to match the surface 62 of the anterior portion 44. The external surface 68 may include a beveled portion 82, which tapers to the flat edge 80.

The feed pipe or tube 67 may be provided to a hole 84 in the external surface 68 of the posterior portion 46. As shown, the hole 84 extends through the posterior portion 46 and, with the feed pipe 67, allows the processing solution 19 to enter the slot coater head 24 at a constant volumetric rate. The processing solution 19 is provided via the hole 84 to the reservoir 66. The reservoir 66 functions to prevent a pressure gradient across the direction of flow. It is noted that while shown in face 68, the hole 84 may be provided through any other surface. Similarly, the reservoir 66 may be provided at a variety of locations internally. Moreover, in other embodiments, a reservoir 66 may not be necessary. Thus, the figures are exemplary only.

A series of holes 86 may be provided as screw holes in both the anterior portion 44 and the posterior portion 46 to allow screws (not shown) to secure the anterior portion 44 to the posterior portion 46 and the shim 48 there between.

The shim 48 (FIG. 5B) is relatively thin and, when secured between the anterior portion 44 and the posterior portion 46, provides a sealed channel through which the developer may be applied. The shim 48 includes a base portion 88 and extending members 90, 92. The base portion 88 and the extending members 90, 92 include screw holes to match those of the anterior and posterior portions. It is noted that in some embodiments, a shim is not necessary; the desired gap may be directly formed into the anterior and/or posterior portions. The interior surfaces 94, 96 of the extending members 90, 92, and the interior surface 98 of the base portion 88, in conjunction with the interior surfaces 52, 70, of the anterior portion 44 and the posterior portion 46, define the channel of width T for the developer. The width T is chosen to allow developer to be applied to the film's emulsion layer.

Figure 4A:
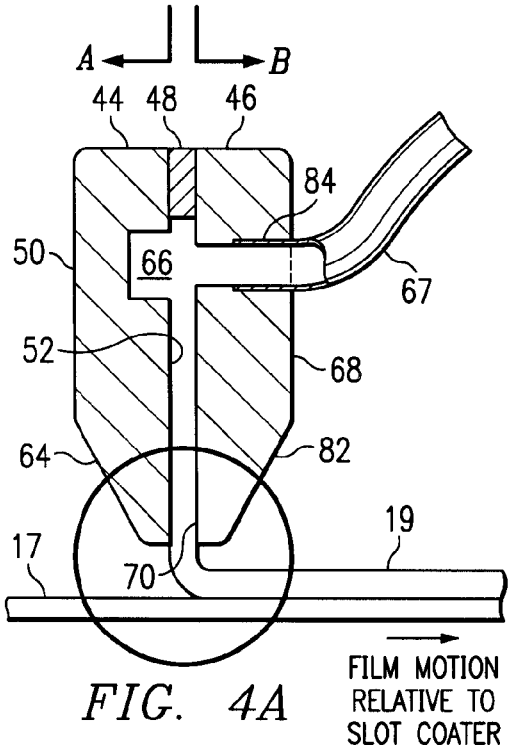
FIGS. 4A and 4B are side elevations of the slot coater of FIG. 3.
Figure 4B:
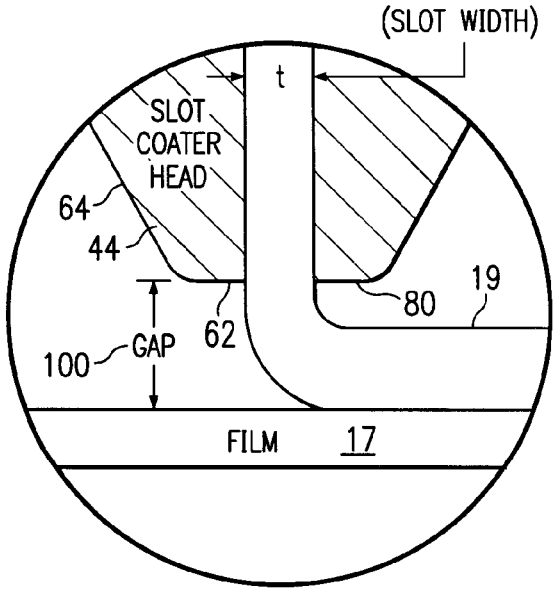
Figure 5A:
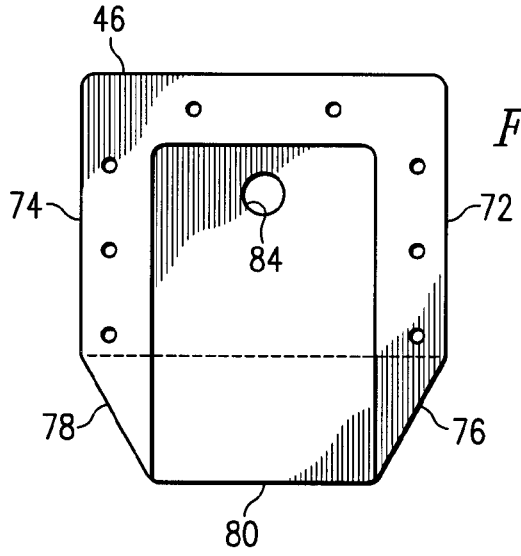
FIGS. 5A–5C are plan views of the components of the slot coater of FIG. 3.
Figure 5B:
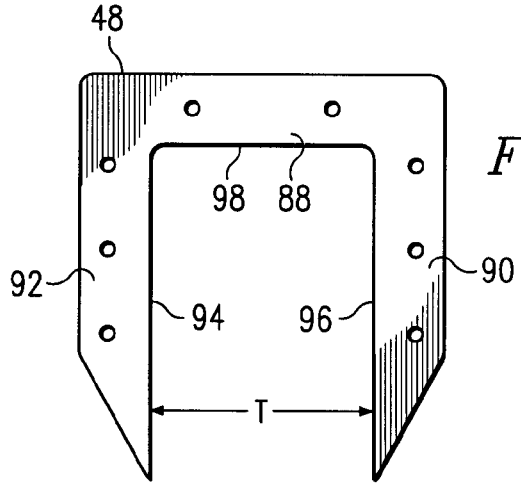
Figure 5C:
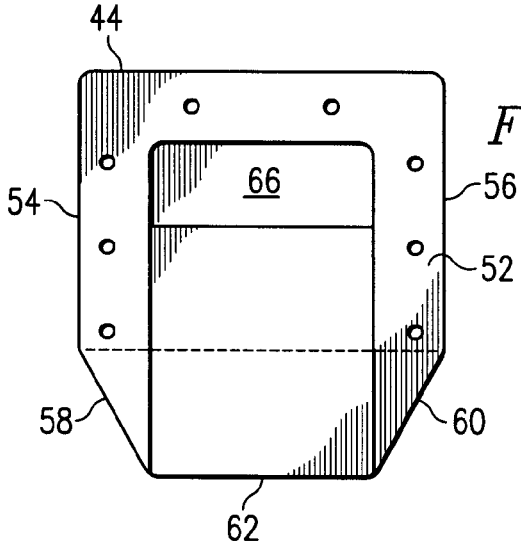

Further, as seen in FIG. 4B, the anterior portion 44 and the posterior portion 46 are separated by the shim (not shown) at a distance t. The slot or channel width t is chosen to optimize the coating process. Finally, the surfaces 62, 80 of the anterior and posterior portions 44, 46 are maintained at a gap width 100, such as 50 to 500 microns, above the film layer 20. Finally, the slot coater head 24 may be positioned at an angle of about 80–100 degrees with respect to the film surface.

It is noted that in alternate implementations, the slot coater head 24 is applied directly to the surface of the film 17. In one such alternate implementation, the slot coater head 24 includes a porous material (not shown), such as a felt-like material, a brush-like material, or a plurality of capillaries, occupying at least a portion of the slot. The porous material may be positioned to directly coat the surface of the film 17. Thus, the figures are exemplary only.

Figure 6A:
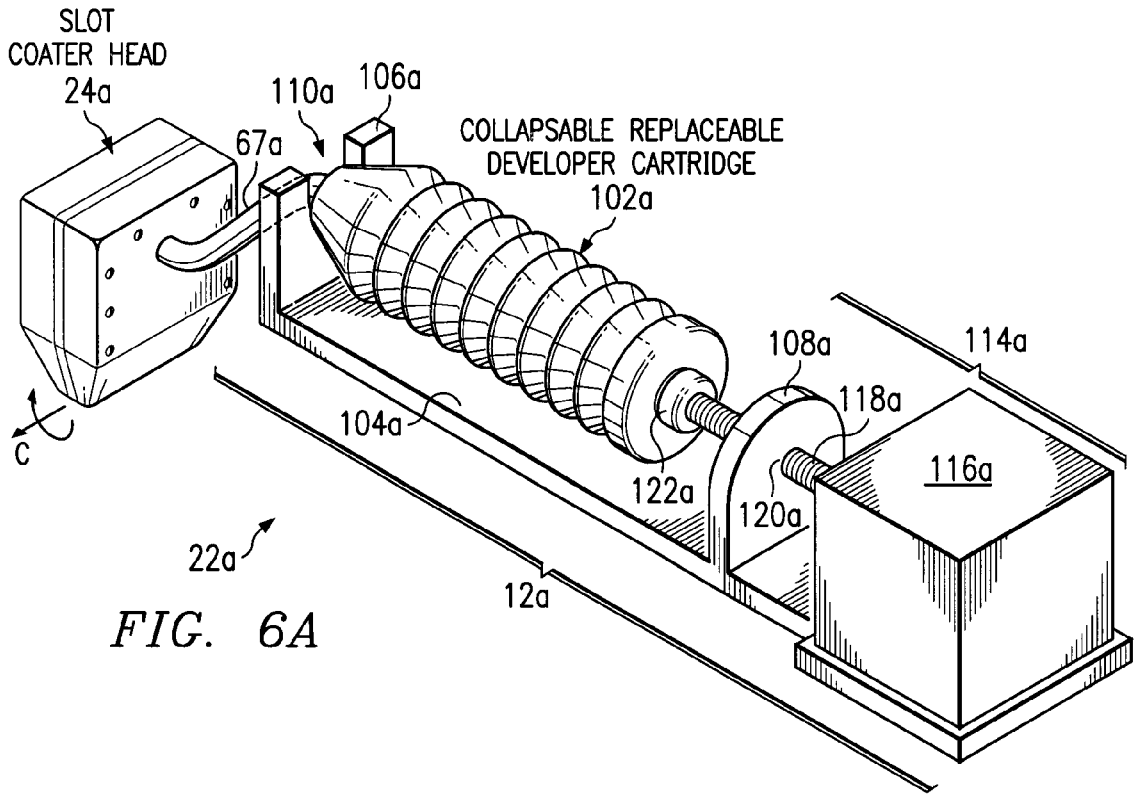
FIGS. 6A and 6B are separate embodiments of slot coater cartridges in accordance with the invention.

An exemplary slot coater assembly 22*a* is shown in FIG. 6A. The slot coater assembly 22*a* includes the slot coater head 24*a* and a replaceable collapsible, reticulated or accordion-like cartridge 102*a*. The replaceable cartridge 102*a* may be embodied in the illustrated accordion-like configuration or may be embodied as any similar cartridge whereby developer may be provided to the slot coater head 24*a* at a controlled volumetric rate. For example, the replaceable cartridge 102*a* may be embodied as a syringe or syringe-like mechanism, or as a collapsible bladder. Further, the cartridge 102*a* may be reusable and capable of being refilled.

The cartridge 102*a* may be a part of a dispenser 12*a*. As illustrated, the dispenser 12*a* includes a base unit 104*a* having one or more support members 106*a*, 108*a*. The forward support member 106*a* includes a notch or hole 110*a* whereby the feed pipe 67*a* may be provided from the cartridge 102*a* to the slot coater head 24*a*.

The dispenser 12*a* further may include a driving unit 114*a*. The driving unit 114*a* may be embodied as a motor such as a step motor 116*a*, which drives a driving member 118*a* such as a lead screw. The rear support member 108*a* includes a notch or hole 120*a* to support the driving member 118*a*. One end of the driving member 118*a* is fixed to a coupler 122*a*, which is coupled to or abuts an end of the cartridge 102*a*. The other end of the driving member 118*a* is provided to the motor 116*a*, shown fixed to the base unit 104*a*. The motor 116*a* causes the driving member 118*a* to be propelled in the direction of the cartridge 102*a* at a constant rate such that developer is provided from the cartridge 102*a* out the lead pipe 110*a* and into the slot coater head 24*a*. Finally, the slot coater head 24*a* may be fixed to rotate about axis C, for example, via actuation of the locating system 28 (FIG. 2).

Figure 6B:
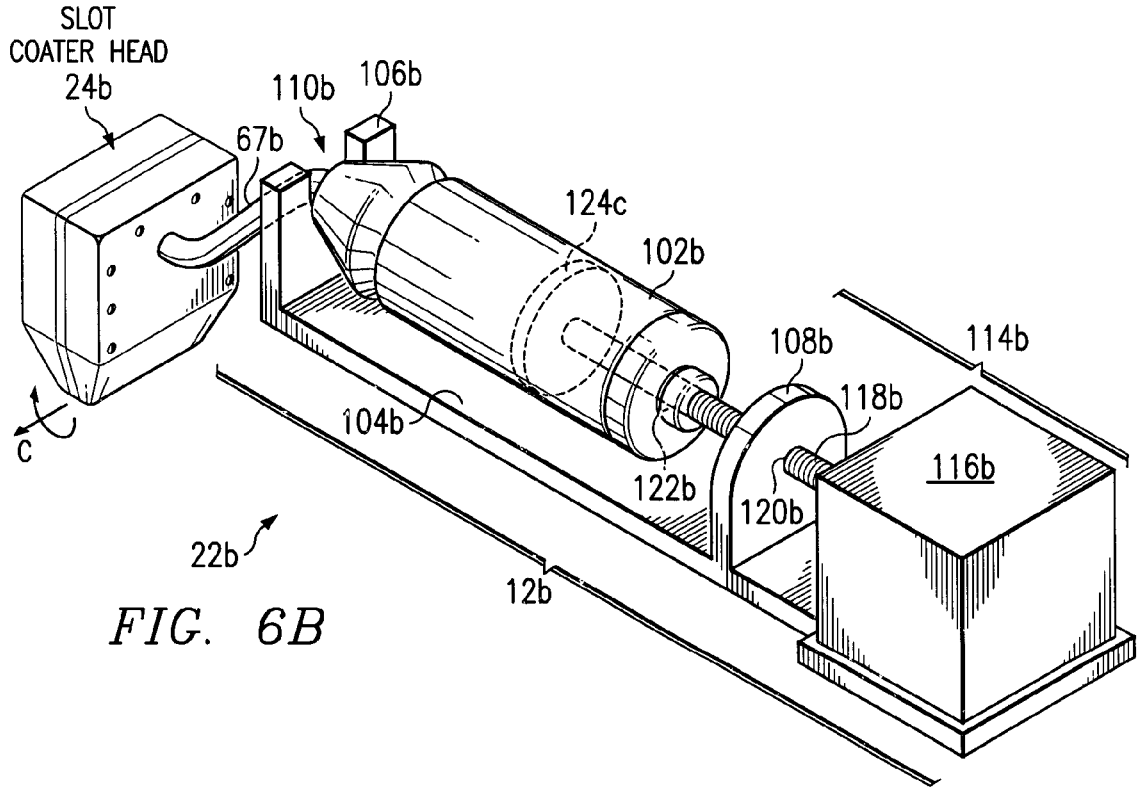

An alternative embodiment of a slot coater assembly 22*b* is shown in FIG. 6B. The embodiment of FIG. 6B employs a syringe pump to provide the developer to the slot coater head 24*b*. The slot coater assembly 22*b* of FIG. 6B includes a slot coater head 24*b* and a cartridge 102*b* such as a syringe.

The syringe 102*b* may be part of a dispenser 12*b*. As illustrated, the dispenser 12*b* includes a base unit 104*b* having one or more support members 106*b*, 108*b*. The forward support member 106*b* includes a notch or hole 110*b* whereby the feed pipe 67*b* may be provided from the syringe 102*b* to the slot coater head 24*b*.

The dispenser 12*b* may include a driving unit 114*b*. The driving unit 114*b* may be embodied as a motor such as a step motor 116*b* coupled to a driving member 118*b*. The driving member 118*b* may be embodied as a lead screw. The rear support member 108*b* includes a notch or hole 120*b* to support the driving member 118*b*. The driving member 118*b* is fixed to a pusher 124*a* by way of a coupler 122*b* and is used to push the developer toward the feed pipe end of the syringe 102*b*. The driving member 118*b* is also provided to the motor 116*b*, shown fixed to the base unit 104*b*. The motor 116*b* causes the driving member 118*b* to move the pusher 124*a* in the slot coater direction at a constant rate such that processing solution is provided from the syringe 102*b* out the lead pipe 67*b* and into the slot coater head 24*b*. Again, the slot coater head 24*b* may be fixed to rotate about axis C.

In the embodiments shown in FIGS. 6A and 6B, the slot coater head 24 is formed as a separate unit from the cartridge or syringe pump. In such an embodiment, the slot coater head 24 may typically be formed from metal, plastic, or similar material. In alternate embodiments, however, the slot coater head and the cartridge or pump may be provided as an integrated, replaceable unit. Exemplary slot coater assemblies employing integrated slot coater heads 24 are shown in FIGS. 7A–7C.

Figure 7A:
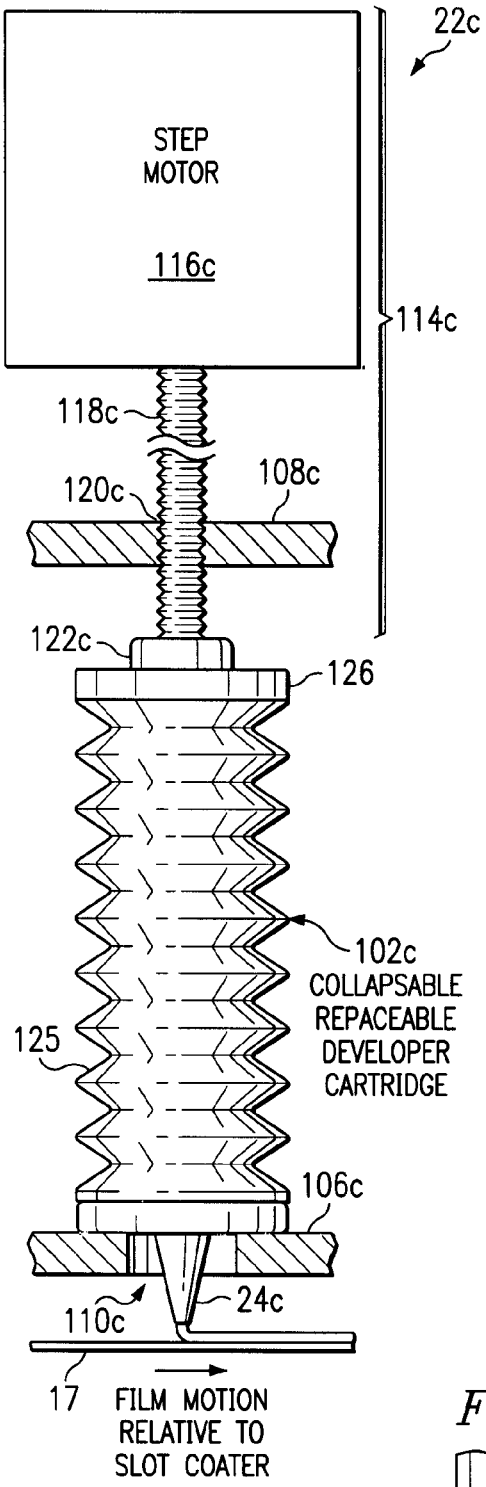
FIGS. 7A–7C are additional embodiment of slot coater cartridges in accordance with the invention.

Turning now to FIG. 7A, an embodiment of an integrated slot coater assembly 22*c* employing an accordion-like cartridge 102*c* is illustrated. As shown, the cartridge 102*c* includes a collapsible portion 125 and a slot coater is head 24*c*. In the embodiment shown, the slot coater head 24*c* is aligned with the axis of the cartridge 102*c*. In alternate embodiments, however, the slot coater head 24*c* may be arranged as a movable unit, as in the embodiments of FIGS. 6A and 6B. The cartridge 102*c* further includes a base 126, which is formed to receive a coupler 122*c*, which is attached to an end of a driving member 118*c*. The driving member 118*c*, along with a motor 116*c*, such as a step motor, together form a driving unit 114*c*.

As shown in FIG. 7A, a support member 108*c* may support the driving member 118*c*. A hole or notch 120*c* may be provided through which the driving member 118*c* extends. Similarly, a support member 106*c* having a hole 110*c* may be provided to support the slot coater head 24*c*. Finally, it is noted that, while shown in a vertical configuration, the slot coater assembly 22*c* may be provided at various angles from vertical, so long as the angle between the film 17 and the slot coater head 24*c* is maintained to allow delivery of the processing solution 19.

Figure 7B:
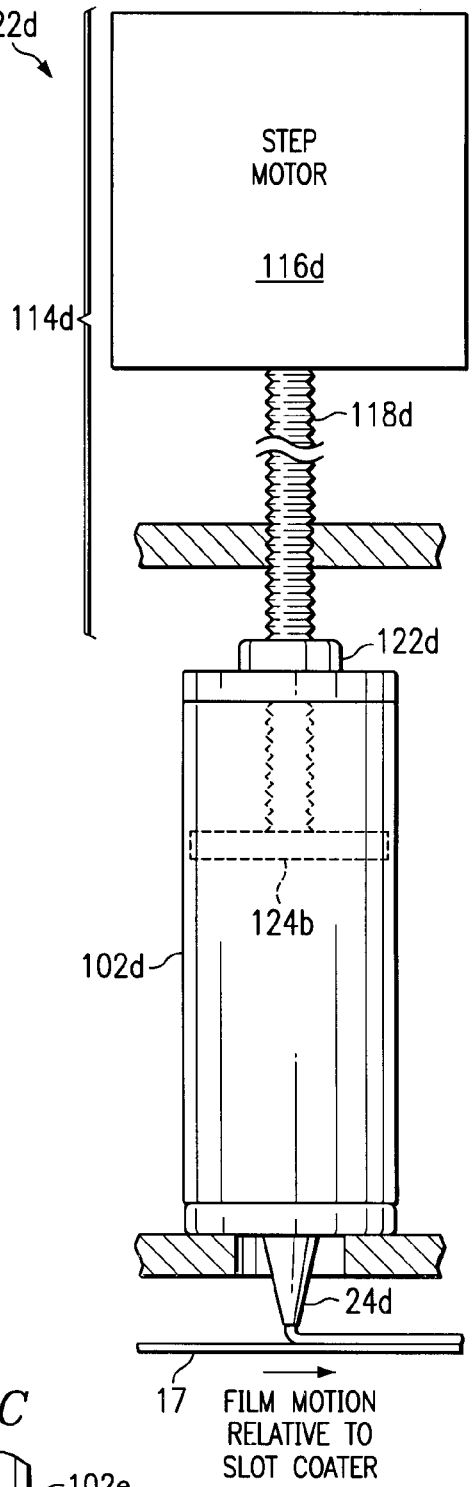
Figure 7C:
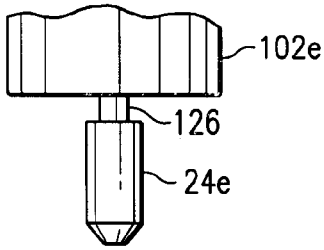

FIG. 7B illustrates a similar embodiment, though employing a syringe pump rather than a collapsible cartridge. In particular, the cartridge 102*d* is embodied as a syringe which includes a slot coater head 24*d* integrated therewith. The syringe 102*d* includes a pusher 124*b* for pushing against the processing solution 19 and forcing it out the slot coater head 24*d*. An end of the pusher 124*b* forms a coupler 122*d* which is attachable to a driving member 118*d*, such as a lead screw. The driving member 118*d* and a motor 116*d* together form a driving unit 114*d*. The driving member 118*d* is driven by the motor 116*d* in a manner similar to that described above.

An alternative coupling for the slot coater head to the cartridge and/or syringe pump is shown in FIG. 7C. In particular, a slot coater head 24*e* may be coupled to the syringe pump or cartridge 102*e* by way of a rigid tube 126. In any of the embodiments of FIGS. 7A–C, the slot coater head 24 may be integrated with the cartridge or syringe in a single manufacturing process. The cartridge and syringe pump may be formed with the slot coater head 24 from injection molded or blow molded plastic.

As noted above, a capping station 30 (FIG. 1) may be provided to cap or seal the slot coater head 24 when not in use. Such a capping station 30 is provided to prevent evaporation of the developer or undesirable effects that may result from exposure to air or contaminants. The capping station 30 may also be provided to wipe clean the head of the slot coater 24 and may also be used to provide a reservoir for purging or priming the slot coater.

Figure 8:
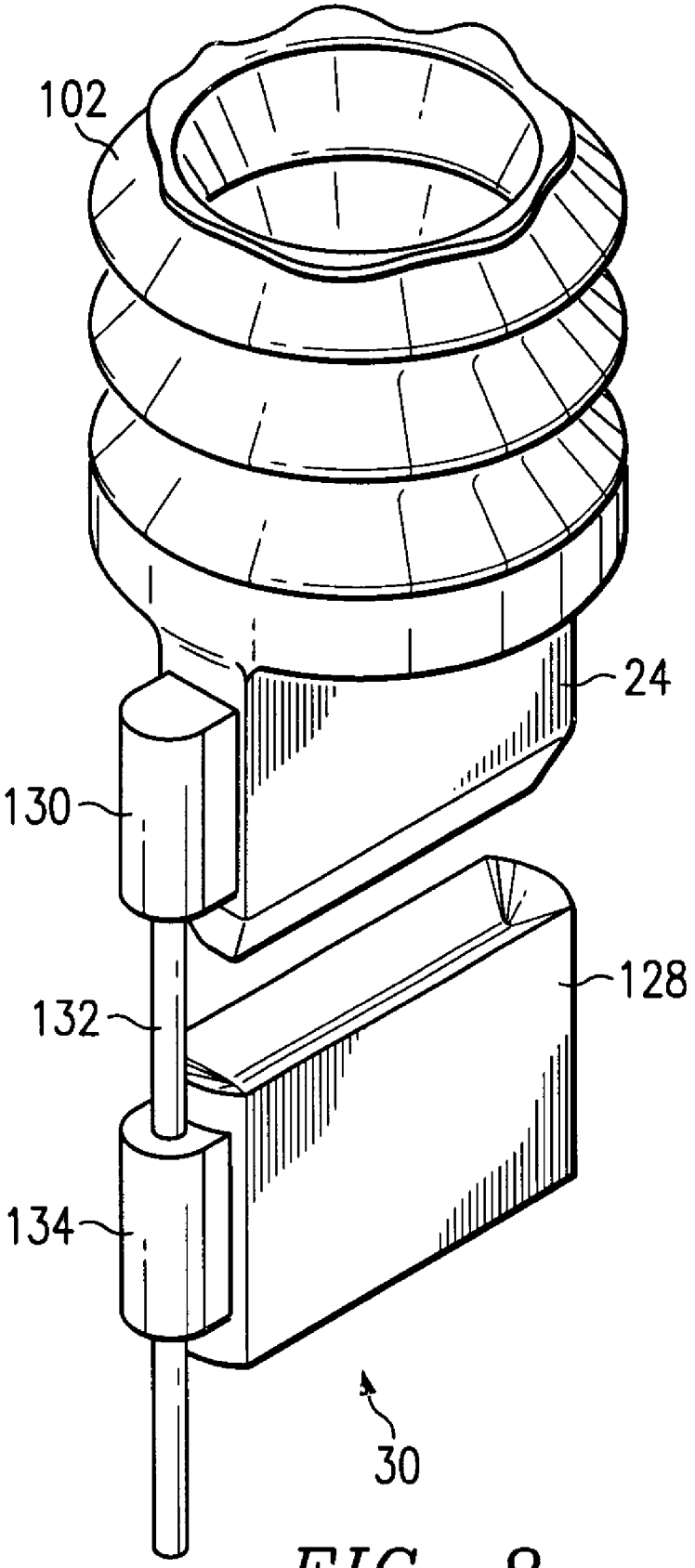
FIG. 8 is a capping station in accordance with one embodiment of the invention.

The capping station 30 may be formed as part of the integrated cartridge(s) described above with reference to FIGS. 7A–7C or may form a separate unit. One embodiment of a capping station is shown in FIG. 8. The capping station 30 includes a receiving portion 128 which may be dimensioned to fit against the slot coater head 24. In particular, the receiving portion 128 may include beveled portions to match the bevels of the slot coater head 24. As shown, the slot coater head 24 includes a mounting member 130 for mounting on a support 132. The capping station's receiving portion 128 also includes a mounting member 134 for mounting. The receiving portion 128 as shown is slidable along support 132 by way of the mounting member 134 and is attached to an actuator (not shown) which may be provided within the digital film processor. The actuator slides the receiving portion 128 into position against the slot coater head 24 when not in use. The receiving portion 128 may also be provided with a reservoir (not shown) for purging or priming the slot coater.

In addition, as discussed above, the slot coater 24 may be fixed to pivot about axis C (FIG. 6A, 6B) by a locating system 28 (FIG. 2). The locating system 28 then pivots the slot coater head 24 from a position in which it applies processing solution to the film 17 to a position where the capping station's receiving portion 128 may be applied. During rotation, the slot coater head 24 may also be positioned to wipe against the receiving portion 128, so as to provide a degree of cleaning.

Modern electronic cameras code image information as bar codes along the edge of film, for example, between the edge of the film and the film sprocket holes. Such information may include, for example, frame number and film type, and the like. One way to read this information is by using the slot coater to apply processing solution along the entire surface of the film. To prevent processing solution from leaking through sprocket holes in the film, potentially damaging the imaging system, a leak controller according to an implementation of the invention is provided.

Figure 9A:
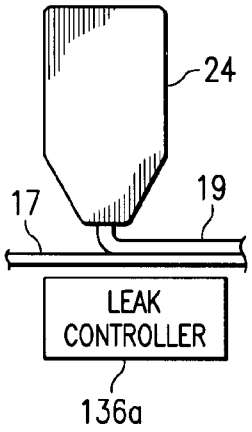
FIGS. 9A–9H illustrate leak controllers according to particular implementations of the invention.

In particular, FIG. 9A illustrates a leak controller 136*a* positioned to prevent leakage of developer off the film 17 or to clean such developer that does leak. The leak controller 136*a* may be embodied as any device suitable to either remove or prevent leaks from the film from affecting the transport and imaging system(s).

Figure 9B:
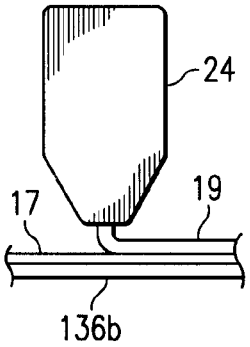

A particular implementation of a leak controller 136*b* is illustrated in FIG. 9B. The leak controller 136*b* is implemented as backing material, such as one or more adhesive tapes applied to the film 17 behind the sprocket holes. Alternatively, the backing material may comprise simply a strip of material held in place by surface tension or the transport mechanism.

Figure 9C:
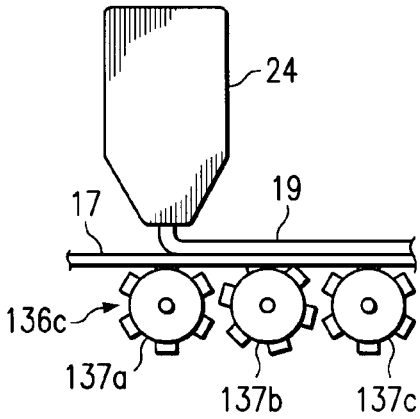
Figure 9D:
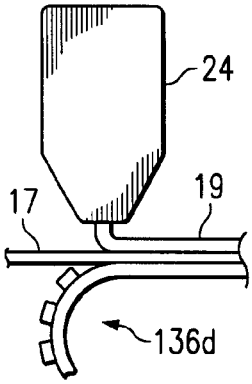

FIG. 9C illustrates another approach to leakage control. In particular, the leakage controller 136*c* of FIG. 9C includes one ore more sprockets 137*a*–137*n* having "teeth" that fit within the sprocket holes in the film 17 and thereby prevent the processing solution from leaking through. Sufficient sprockets may be provided for the processing solution 19 to dry enough so that it no longer runs through. A similar approach is shown in the implementation of FIG. 9D. The leak controller 136*d* is implemented as one or more sprocket belts, again having teeth adapted to fit the sprocket holes of the film 17 and push up processing solution 19 and prevent it from leaking through.

Figure 9E:
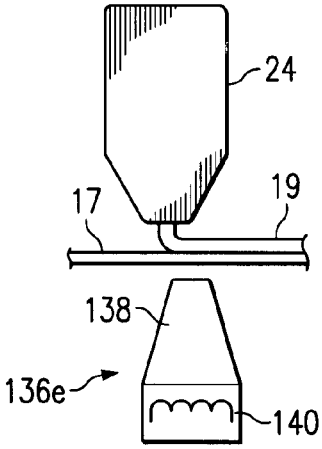
Figure 9F:
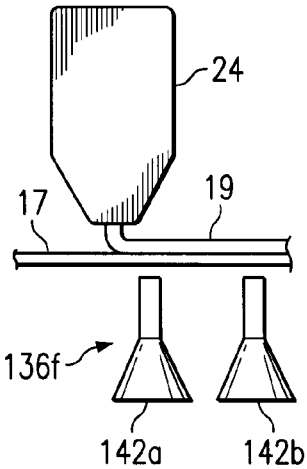

FIGS. 9E and 9F illustrate leak controllers 136 which employ air to control leakage. In FIG. 9E, the leak controller 136*e* is implemented as a blower 138 that is used to dry out the processing solution 19 before it can leak through the sprocket holes. The blower 140 may include a heating element 140. The leak controller 136*f* of FIG. 9F employs one or more suction devices 142*a*–142*n* to pull the developer through the sprocket holes so that it does not leak through. Any device suitable to create the desired level of suction may be employed.

Figure 9G:
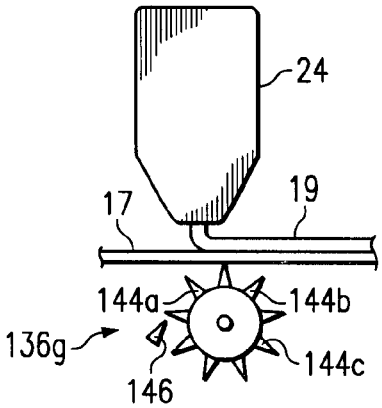
Figure 9H:
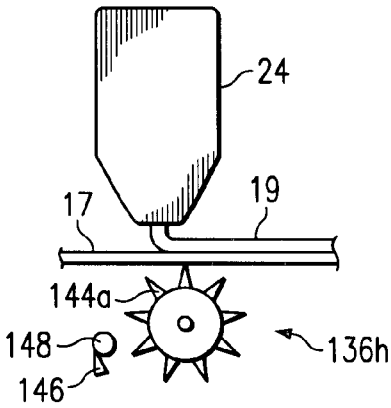

The leak controller 136*g* of FIG. 9G is implemented as one or more flexible or non-flexible squeegee blades 144*a*–144*n* that are rotated into position against the underside of the film 17 to remove the processing solution 19 as it falls through the sprocket holes. The processing solution 19 is then removed from the squeegee blades with a doctor blade 146. A similar approach is shown in the leak controller 136*h* of FIG. 9H. In this case, the processing solution 19 on the squeegee blade or blades 144*a*–144*n* is cleaned off on a wheel 148 and the wheel cleaned by another squeegee 146.

Figure 10:
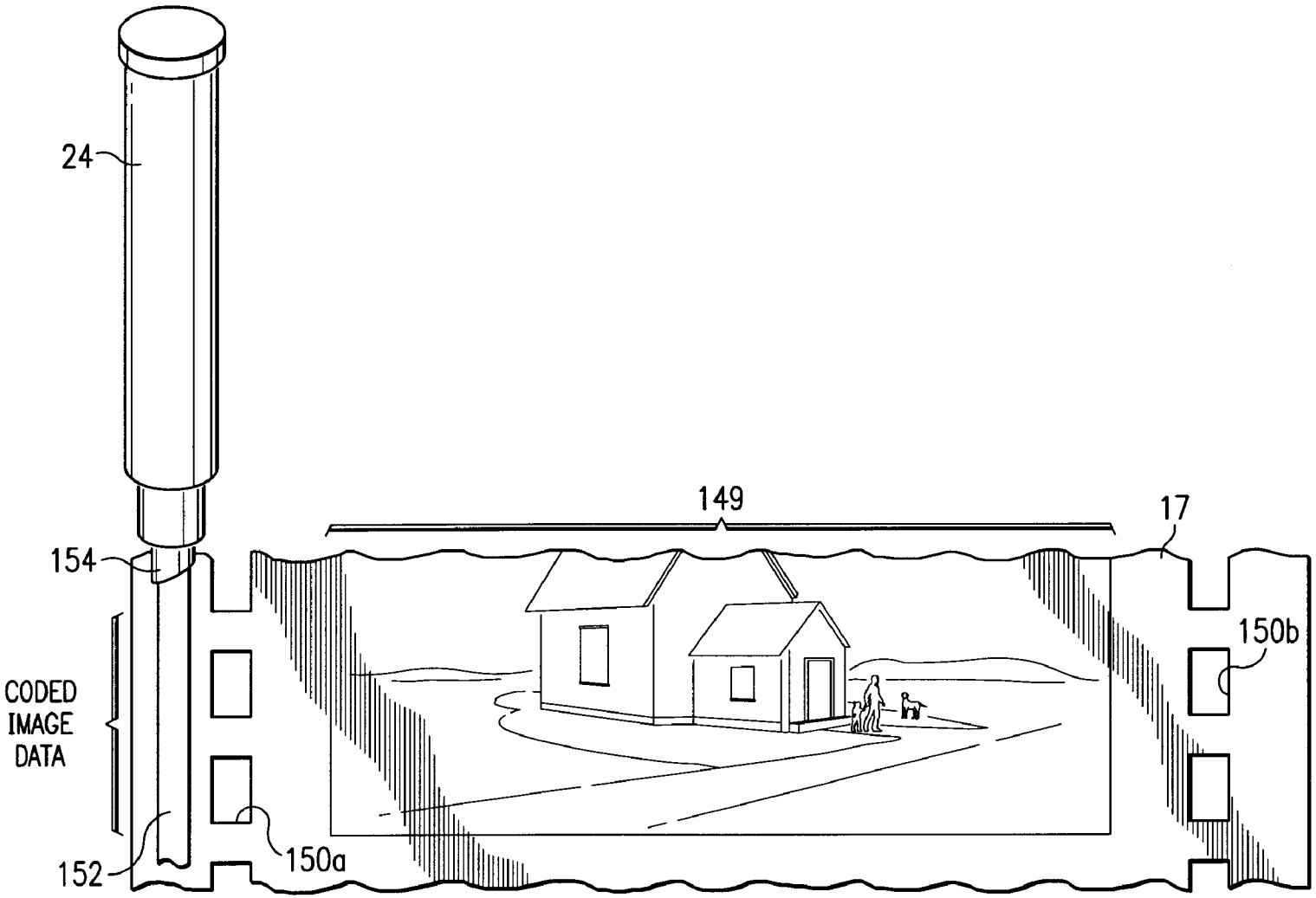
FIG. 10 illustrates an edge slot coater dispenser according to a particular implementation of the invention.

An alternative to applying processing solution 19 to the entire surface of the film 17 is to apply processing solution 19 only to the image area of the film 17 and also only to the area of the film 17 containing coded data, thereby ensuring that no processing solution is applied to clog the sprocket holes. An implementation of a slot coater for this purpose is shown in FIG. 10. Shown are film 17 and a slot coater 24. The film 17 includes an image area 149, sprocket holes 150*a*, 150*b*, and a coded information area 152. The slot coater 24 may be embodied as a slot coater similar but smaller in form and/or footprint than the slot coater described in FIG. 3 and FIG. 4 above. Alternatively, the slot coater 24 may be implemented as a disposable "pen" having a porous tip 154 that is maintained in contact with the surface of the film 17. Alternatively, an "ink jet"-type head may be employed to apply the developer to the coded information area 152.

Once the processing solution 19 has been applied, a film processing system similar to that denoted by reference numeral 16 above may be used to read the coded information. The processor 18 may then use this information during development of the image area 149, as generally described above.

The invention described in the above detailed description is not intended to be limited to the specific form set forth herein, but is intended to cover such alternatives, modifications and equivalents as can reasonably be included within the spirit and scope of the appended claims. To aid the Patent Office and any readers of any patent issued on this application in interpreting the claims appended hereto, applicants wish to note that they do not intend any of the appended claims to invoke paragraph 6 of 35 U.S.C. §112 as it exists on the date of filing hereof unless the words "means for" or "step for" are used in the particular claim.

What is claimed is:

1. A film developing system, comprising:

a delivery system including a slot coater for coating a processing solution onto film; and a digital image processing station operable to scan the coated film and produce at least one digital image.

2. A film developing system according to claim 1, wherein said delivery system also includes a high capacity reservoir operable to contain sufficient quantity of developer to develop multiple rolls of film without recirculating the processing solution.

3. A film developing system according to claim 1, wherein the delivery system comprises a collapsible container for dispensing the processing solution.

4. A film developing system according to claim 3, further comprising a pumping system disposed between the slot coater and the collapsible container.

5. A film developing system according to claim 3, further comprising a pumping system operable to compress the collapsible container.

6. A film developing system according to claim 3, wherein the delivery system forms an integrated unit that includes the collapsible container and the slot coater.

7. A film developing system, comprising:

a delivery system including a slot coater for coating a processing solution onto film;

a digital image processing station operable to scan the coated film and produce at least one digital image; and a capping station adapted to substantially seal the slot coater when the slot coater is not coating the film.

8. A method for processing film, comprising:

providing a delivery system having at least one slot coater;

applying at least one processing solution to the film with the slot coater without the processing solution substantially draining from the film;

scanning the coated film to produce at least one digital image; and outputting the at least one digital image.

9. A method according to claim 8, wherein outputting the at least one digital image includes printing the at least one digital image.

10. A method according to claim 8, wherein the delivery system comprises a first slot coater operable to apply a developing solution and a second slot coater operable to apply a second processing solution, wherein the developer solution is different than the second processing solution.

11. A method according to claim 8, further comprising the step of substantially stopping development of the film prior to scanning the coated film.

12. A method for processing film, comprising:

providing a delivery system having at least one slot coater;

applying at least one processing solution to the film with the slot coater without the processing solution substantially draining from the film;

scanning the coated film to produce at least one digital image;

outputting the at least one digital image; and substantially sealing the slot coater when the slot coater is not coating the film.

13. A slot coater assembly comprising:

a housing;

a collapsible container disposed within the housing, wherein the collapsible container contains a developer;

a slot coater disposed within the housing and in fluid communication with the collapsible container, wherein the slot coater operates to coat the developer onto a film.

14. A slot coater assembly according to claim 13, wherein the collapsible container is refillable.

15. A slot coater assembly according to claim 13, wherein the slot coater assembly forms a removable and replaceable unit for an electronic film processing system.

16. A system for electronically processing film, comprising:

an integrated developer applicator comprising:

a slot coater operable to coat the film with a developer solution without the developer solution substantially draining from the film;

a reservoir operable to contain the developer solution; and a pumping system operable to deliver the developer solution from the reservoir to the slot coater; and at least one digital image processing station operable to scan the coated film and produce at least one digital image.

17. A system according to claim 16, wherein the pumping system is disposed between the slot coater and the reservoir.

18. A system according to claim 16, wherein the reservoir can be refilled with developer solution.

19. A system according to claim 16, wherein the reservoir comprises a collapsible container.

20. A system according to claim 16, further comprising a printer operable to print the at least one digital images.

21. A system for electronically processing film, comprising:

an integrated developer applicator comprising:

a slot coater operable to coat the film with a developer solution without the developer solution substantially draining from the film;

a reservoir operable to contain the developer solution; and a pumping system operable to deliver the developer solution from the reservoir to the slot coater; and at least one digital image processing station operable to scan the coated film and produce at least one digital image; and a capping station operable to substantially seal the slot coater.

* * * * *